US012497856B2

(12) United States Patent
Coffey et al.

(10) Patent No.: US 12,497,856 B2
(45) Date of Patent: Dec. 16, 2025

(54) HIGH EXPANSION MULTI-SLIP FRAC PLUG WITH NARROW CROSS-SECTION

(71) Applicant: LATERAL COMPLETIONS LTD., Okotoks (CA)

(72) Inventors: Nathan Coffey, Okotoks (CA); Robert McQuillan, Okotoks (CA); Leigh Durling, Calgary (CA)

(73) Assignee: Lateral Completions Ltd., Okotoks (CA)

( * ) Notice: Subject to any disclaimer, the term of this patent is extended or adjusted under 35 U.S.C. 154(b) by 7 days.

(21) Appl. No.: 17/956,709

(22) Filed: Sep. 29, 2022

(65) Prior Publication Data

US 2023/0103389 A1 Apr. 6, 2023

Related U.S. Application Data

(60) Provisional application No. 63/250,068, filed on Sep. 29, 2021.

(51) Int. Cl.
*E21B 33/128* (2006.01)

(52) U.S. Cl.
CPC ..... *E21B 33/128* (2013.01)

(58) Field of Classification Search
CPC ..... E21B 33/128; E21B 33/134
See application file for complete search history.

(56) References Cited

U.S. PATENT DOCUMENTS

| | | | | |
|---|---|---|---|---|
| 4,901,794 | A * | 2/1990 | Baugh | E21B 33/1293 166/134 |
| 7,168,494 | B2 | 1/2007 | Starr et al. | |
| 9,359,863 | B2 | 6/2016 | Streich et al. | |
| 10,422,199 | B1 | 9/2019 | Subbaraman et al. | |
| 11,326,416 | B1 * | 5/2022 | Zheng | E21B 33/1292 |
| 2011/0048743 | A1 | 3/2011 | Stafford et al. | |
| 2014/0209325 | A1 * | 7/2014 | Dockweiler | E21B 23/01 166/217 |
| 2022/0034192 | A1 * | 2/2022 | Harris | E21B 23/06 |

* cited by examiner

*Primary Examiner* — Theodore N Yao
(74) *Attorney, Agent, or Firm* — Gowling WLG (Canada) LLP

(57) ABSTRACT

A frac plug has multiple conical-shape, radially outwardly expandable slip structures sandwiched between an actuator ring and a first ring. The smaller inner-diameter (ID) end of each slip structure extends into the larger ID end of the neighboring one. The actuator ring has a conical-shape portion extendable into the larger ID end of the neighboring slip structure. The first ring and actuator ring are movable towards each other to extend the conical-shape portion of the actuator ring into the neighboring slip structure thereby subsequently causing each slip structure extending its smaller ID end into the neighboring slip structure to expand the slip structure furthest to the actuator ring for engaging the slips thereon with a casing. The frac plug may comprise a seal element sandwiched between the actuator ring and a second ring, which are movable towards each other to compress and expand the seal element to engage the casing.

9 Claims, 10 Drawing Sheets

HIGH EXPANSION MULTI-SLIP FRAC PLUG WITH NARROW CROSS-SECTION

FIELD OF THE DISCLOSURE

The present disclosure relates generally to downhole tools, and in particular to downhole tools such as frac plugs used in fracking of hydrocarbon formations.

BACKGROUND

Frac plugs are used in the completions of oil and gas wells to isolate between zones when fracturing or stimulation of a hydrocarbon formation is required. Sometimes there are up to 70 zones in a single wellbore, wherein each zone needs to be isolated using a frac plug for injection of fracking fluids used in fracturing a hydrocarbon formation for production and, after fracturing, the frac plug may need to be removed for oil/gas production.

Generally, a frac plug comprises a moveable slip having means thereon for gripping the interior wall of a tubing string, and an expandable rubber element thereon to anchor to the casing wall and provide a high pressure seal to isolate the wellbore from the zones below.

There have been many frac plugs made of various materials such as cast iron, composites, aluminum, dissolvable materials, and the like.

For example, U.S. Pat. No. 10,422,199 B1 to Subbaraman, et al., teaches a dissolvable frac plug. The dissolvable frac plug has an internal chamber surrounded by an external wall with the chamber containing a dry powder component in an amount sufficient to combine with ground water or other wellbore fluids to form a solution or environment that enhances dissolution of the plug. The dry powder is released from the chamber as a portion or portions of the external wall dissolves due to contact with water or other wellbore fluids.

U.S. Pat. No. 9,359,863 B2 to Streich, et al., teaches downhole tools and methods of removing such tools from wellbores, and more particularly, downhole tools designed to be comprised of dissolvable materials or frangible materials and methods for dissolving or fragmenting such downhole tools in situ.

US Patent Application Publication No. 2011/0048743 to Stafford, et al., teaches a dissolvable bridge plug configured with components for maintaining anchoring and structural integrity for high pressure applications. Embodiments of the plug are configured such that these components may substantially dissolve to allow for ease of plug removal following such applications. In one embodiment the plug may effectively provide isolation in a cased well for applications generating over about 8,000-10,000 psi. At the same time, by employment of a dissolve period for the noted components, such a plug may be drilled-out in less than about 30 minutes, even where disposed in a lateral leg of the well.

U.S. Pat. No. 7,168,494 B2 to Starr, et al., teaches a disposable downhole tool comprising a material that dissolves when exposed to a chemical solution, an ultraviolet light, a nuclear source, or a combination thereof. In an embodiment, the material comprises an epoxy resin, a fiberglass, or a combination thereof. In another embodiment, the material comprises a fiberglass and a binding agent. The material may also be customized to achieve a desired dissolution rate of the tool. In an embodiment, the disposable downhole tool further comprises an enclosure for storing the chemical solution. The tool may also comprise an activation mechanism for releasing the chemical solution from the enclosure. In an embodiment, the disposable downhole tool is a frac plug. In another embodiment, the tool is a bridge plug. In yet another embodiment, the tool is a packer.

A disadvantage of conventional frac plugs is that typically these frac plugs have a large outer diameter (OD) of about 88% to 92% of the wellbore casing inner diameter (ID). In deviated wells, for example, which transition from a vertical well to a horizontal well via a curved portion, tubing inserted within such a well bore typically requires a frac plug to be a substantially lesser diameter than the tubing, in order for the frac plug to be moved from the vertical portion of the wellbore along a curved portion to the horizontal portion of the tubing, where the fracking operations are typically carried out. Prior art frac plugs have typically faced the dilemma of needing to be close to the inner diameter of the tubing in order to effectively seal, but now with deviated wells need to be substantially less than the diameter of the tubing, in order to pass along and through a curved or deviated portion of the tubing.

Specifically, as fracturing technology grows, the oil and gas industry is seeing more casing deformations, anomalies, and/or restrictions which may require a frac plug with a smaller OD but with the same slip expansion capability. For example, in deviated wells which transition from a purely vertical bore to a substantially horizontal bore, there is typically a length of casing or tubing that follows a generally curved path. Likewise, casing or tubing that has had the nominal ID compromised due to geological shifts or deformities caused by surface interventions likewise make it difficult for a conventional frac plug of any substantial length, because of their large ODs being only marginally less than the conventional ID of casing or a tubing string, may be difficult to pass through various casing deformations, anomalies, curved portions and/or restrictions for zone isolation.

Failure to isolate zones below a restricted ID may cause a loss of future wellbore production.

Therefore, there is a clear need in the industry for a downhole tool and in particular a frac plug used in well completions which in a in a non-deployed state, has a relatively small cross-section and thus is consequently more able to easily pass through curved or deviated tubing within a wellbore, but which nevertheless is still able when deployed to satisfactorily grip and seal the inner portion of tubing string during fracking or well completions operations.

SUMMARY OF THE INVENTION

The frac plug of the present invention advantageously is able to employ multiple slips or slip layers formed of two or more slip layers, thereby increasing the amount of radial outward expansion.

Consequently, because of such greater radial outward expansion when deployed, in a non-deployed state a smaller cross-sectional profile of such frac plug can be used, in the range of only 70-75% of tubing or casing ID, while nevertheless due to multi-slip design, having sufficient necessary radial expansion to allow satisfactory engagement of at least one of the plurality of slips with an interior of the tubing or casing.

According to one aspect of this invention there is provided a downhole apparatus having a first side and a second side; the apparatus comprises: an actuator ring having a longitudinal bore and a first, conical frustum portion tapering towards the first side; a plurality of slip structures on the first side of the actuator ring, the plurality of slip structures juxtaposed to each other in series, each of the plurality of slip structures having a longitudinal bore and a conical frustum portion tapering towards the first side and being radially outwardly expandable, and one of the plurality of slip structures furthest on the first side comprising a plurality of slips; and a first end ring having a first portion engaging the first side of the slip structure furthest on the first side and a second portion extending from the first portion into the longitudinal bore of the actuator ring and engaging therewith for sandwiching the plurality of slip structures between the actuator ring and the first end ring; the actuator ring is longitudinally movable with respect to the first end ring to extend the conical frustum portion thereof into the bore of the neighboring one of the plurality of slip structures on the first side thereof and subsequently actuating each one of the plurality of slip structures to extend the conical frustum portion thereof into the bore of the neighboring one of the plurality of slip structures on the first side thereof eventually for radially outwardly expanding the slip structure furthest on the first side.

In some embodiments, the downhole apparatus further comprises: a seal element on the second side of the conical frustum portion of the actuator ring, the second side longitudinally opposite to the first side, the seal element having a longitudinal bore; and a second end ring on the second side of the seal element; the actuator ring comprises a second portion extending towards the second side through the bore of the seal element and engaging the second end ring; and the second end ring is movable towards the actuator ring for compressing and radially outwardly expanding the seal element.

In some embodiments, the downhole apparatus further comprises: at least one expansion ring longitudinally movably coupled to the conical frustum portion of the actuator ring on the second side of the plurality of slip structures, the at least one expansion ring radially outwardly expandable when longitudinally moving towards the second side for facilitating and supporting the radially outwardly expansion of the plurality of slip structures. The at least one expansion ring may further act as a back-up to the seal element described above.

In some embodiments, the at least one expansion ring comprises a pair of C-shape expansion rings each having a gap; and wherein the pair of C-shape expansion rings are oriented such that the gaps the C-shape expansion rings are unaligned.

Permutations and combinations of the above features may be employed in the frac plug of the present invention, and in particular the invention of the present design may possess a seal element and/or at least one expansion ring, which serve as an expanding seal.

In some embodiments, the at least one expansion ring comprises a spiral ring.

In another second aspect of the invention, the invention comprises a generally cylindrical downhole apparatus having a first side and a second side and a longitudinal axis, the apparatus comprising:

an actuator ring having a longitudinal bore co-axially aligned on said longitudinal axis of said downhole apparatus and a first conical frustum portion tapering radially inwardly towards the first side;

a plurality of slip structures each having a bore co-axially situated on said longitudinal axis of said downhole apparatus on the first side of the actuator ring, the plurality of slip structures juxtaposed with each other in series, each of the plurality of slip structures having a longitudinal bore and a conical frustum portion tapering inwardly towards the first side and being radially outwardly expandable, and one of the plurality of slip structures on the first side comprising a plurality of slips; and a first end ring having a first portion engaging the first side of the slip structure furthest on the first side and a second portion extending longitudinally along said longitudinal axis from the first portion into the longitudinal bore of the actuator ring and engaging therewith for sandwiching the plurality of slip structures between the actuator ring and the first end ring;

wherein the actuator ring is longitudinally movable with respect to the first end ring to permit the conical frustum portion of said actuator ring to extend into the bore of a neighboring one of the plurality of slip structures and subsequently thereby actuating each one of the plurality of slip structures to extend the conical frustum portion thereof into the bore of the neighboring one of the plurality of slip structures for radially outwardly expanding each slip structure.

In a refinement of the second aspect, the downhole apparatus further comprises:

a seal element on the second side of the conical frustum portion of the actuator ring, the second side longitudinally opposite to the first side, the seal element having a longitudinal bore co-axial with said longitudinal axis;

a second end ring on the second side of the seal element;

wherein the actuator ring comprises a second portion extending towards the second side through the bore of the seal element and engaging the second end ring; and wherein the second end ring is movable towards the actuator ring for compressing and radially outwardly expanding the seal element.

In a further refinement of the second aspect, the second aspect further comprises:

at least one expansion ring longitudinally movably coupled to the conical frustum portion of the actuator ring on the second side of the plurality of slip structures, the at least one expansion ring radially outwardly expandable when longitudinally moving towards the second side for facilitating and supporting the radially outwardly expansion of the plurality of slip structures.

In a further refinement of the further refinement of the second aspect, the the at least one expansion ring comprises a pair of C-shape expansion rings each having a gap; and wherein the pair of C-shape expansion rings are oriented such that the gaps the C-shape expansion rings are unaligned. The annular ring may further be provided with a ball seat on a side thereof corresponding to a second side of said downhole apparatus.

In a third aspect, the generally cylindrical downhole apparatus has a first downhole side and a second uphole side and a longitudinal axis, and further comprises:

an actuator ring having a longitudinal bore co-axially aligned on said longitudinal axis of said downhole apparatus and a first conical frustum portion tapering radially inwardly towards said downhole side;

a plurality of slip structures each having a bore co-axially situated on said longitudinal axis of said downhole apparatus on the downhole side of the actuator ring, the plurality of slip structures juxtaposed with each other in series, each of the plurality of slip structures having a longitudinal bore and a conical frustum portion tapering inwardly towards the downhole side and being radially outwardly expandable; and a first end ring having a first portion engaging the downhole side of the most downhole of the plurality of slip structures and a second portion extending longitudinally towards the uphole side along said longitudinal axis from the first portion into the longitudinal bore of the actuator ring and engaging therewith for sandwiching the plurality of slip structures between the actuator ring and the first end ring;

wherein the actuator ring is longitudinally movable with respect to the first end ring to permit the conical frustum portion of said actuator ring to extend into the bore of a neighboring one of the plurality of slip structures on a side thereof most proximate the uphole side of said downhole apparatus and subsequently actuating each one of the plurality of slip structures to extend the conical frustum portion thereof into the bore of the neighboring one of the plurality of slip structures for radially outwardly expanding each slip structure.

In a further refinement of the third aspect, the downhole apparatus further comprises:

a seal element on a uphole side of the conical frustum portion of the actuator ring, the seal element having a longitudinal bore co-axial with said longitudinal axis; and a second end ring on a uphole side of the seal element;

wherein the actuator ring comprises a second portion extending towards the uphole side through the bore of the seal element and engaging the second end ring; and wherein the second end ring is movable towards the actuator ring for compressing and radially outwardly expanding the seal element.

In another refinement of the third aspect, such downhole apparatus further comprises:

at least one expansion ring longitudinally movably coupled to the conical frustum portion of the actuator ring on the second side of the plurality of slip structures, the at least one expansion ring radially outwardly expandable when longitudinally moving towards the second side for facilitating and supporting the radially outwardly expansion of the plurality of slip structures.

In a further refinement of the third aspect, the at least one expansion ring comprises a pair of C-shape expansion rings each having a gap; and wherein the pair of C-shape expansion rings are oriented such that the gaps the C-shape expansion rings are unaligned. The annular ring may further be provided with a ball seat on a side thereof corresponding to a second side of said downhole apparatus.

In a fourth aspect of the generally cylindrical downhole apparatus of the apparatus of the present invention having a downhole end and a second uphole end and a longitudinal axis, such apparatus comprises:

an actuator ring having a longitudinal bore co-axially aligned on said longitudinal axis of said downhole apparatus and a first conical frustum portion tapering radially inwardly towards said uphole side;

a plurality of slip structures each having a bore co-axially situated on said longitudinal axis of said downhole apparatus on the uphole side of the actuator ring, the plurality of slip structures mutually juxtaposed with each other in series, each of the plurality of slip structures having a longitudinal bore and a conical frustum portion tapering inwardly towards the uphole side and being radially outwardly expandable;

a cylindrical seal element having a longitudinal bore situated co-axially with said longitudinal axis;

a first end ring on an uphole side of said downhole apparatus having a first portion engaging the uphole side of the most uphole of the plurality of slip structures and a second portion extending longitudinally downhole along said longitudinal axis from the first portion into the longitudinal bore of the actuator ring a for sandwiching the plurality of slip structures between the actuator ring and the first end ring;

wherein the actuator ring is longitudinally movable with respect to the first end ring to permit the conical frustum portion of said actuator ring to extend into the bore of a neighboring one of the plurality of slip structures on a side thereof most proximate the downhole side of said downhole apparatus and subsequently actuating each one of the plurality of slip structures to extend the conical frustum portion thereof into the bore of the neighboring one of the plurality of slip structures for radially outwardly expanding each slip structure and compressing said seal element.

In a refinement of the fourth aspect, the downhole apparatus further comprises:

a seal element on a uphole side of the conical frustum portion of the actuator ring, the seal element having a longitudinal bore co-axial with said longitudinal axis; and a second end ring on a uphole side of the seal element;

wherein the actuator ring comprises a second portion extending towards the uphole side through the bore of the seal element and engaging the second end ring; and wherein the second end ring is movable towards the actuator ring for compressing and radially outwardly expanding the seal element.

In an alternative refinement of the fourth aspect, the downhole apparatus further comprises:

at least one expansion ring longitudinally movably coupled to the conical frustum portion of the actuator ring on the second side of the plurality of slip structures, the at least one expansion ring radially outwardly expandable when longitudinally moving towards the second side for facilitating and supporting the radially outwardly expansion of the plurality of slip structures.

In a further refinement of the fourth aspect, the at least one expansion ring comprises a pair of C-shape expansion rings each having a gap; and wherein the pair of C-shape expansion rings are oriented such that the gaps the C-shape expansion rings are unaligned. The annular ring may further be provided with a ball seat proximate an uphole side of the downhole apparatus.

BRIEF DESCRIPTION OF THE DRAWINGS

The following figures depict various non-limiting aspects of the invention, in which:

FIGS. 15A to 15C show an assembly process of the frac plug shown in FIG. 1A, wherein FIG. 15A is a cross-sectional view of the frac plug partially assembled using the assembled seal element, top sub, and body lock ring shown in FIGS. 5, 6A, and 7, FIG. 15B is a cross-sectional view of the frac plug further assembled from that shown in FIG. 15A and with the keep ring, latch ring or compression lock ring, and inner sleeve shown in FIGS. 2, 2A, and 4, and FIG. 15C is a cross-sectional view of the assembled frac plug;

FIGS. 17A to 17D show a process for setting the frac plug shown in FIG. 1A downhole in a wellbore casing, wherein FIG. 17A is a cross-sectional view of a setting tool coupled to the frac plug shown in FIG. 1A and extending downhole in a wellbore casing, FIG. 17B is a cross-sectional view of the setting tool actuating the frac plug shown in FIG. 1A to set in the wellbore casing, FIG. 17C is a cross-sectional view of the frac plug shown in FIG. 1A set in the wellbore casing with the setting tool retrieved to the surface, and FIG. 17D is a cross-sectional view of the frac plug shown in FIG. 1A set in the wellbore casing with a ball dropped from the surface and seating against the ball seat of the frac plug;

DETAILED DESCRIPTION OF SOME PREFERRED EMBODIMENTS OF THE INVENTION

Embodiments herein disclose a downhole tool such as a frac plug with high-expansion slip structures. The frac plug comprises a plurality of conically-shaped, radially outwardly expandable slip structures with the smaller inner-diameter (ID) end of each slip structure extending into a larger ID end of the neighboring slip structure. The plurality of slip structures are sandwiched between an actuator ring and a first end ring. The actuator ring has a conical-shape portion extendable into the larger ID end of the neighboring slip structure. The first end ring and actuator ring are movable towards each other to extend the conical-shape portion of the actuator ring into the neighboring slip structure thereby subsequently causing each slip structure extending its smaller ID end into the neighboring slip structure to eventually expand the slip structure furthest to the actuator ring for engaging the slips thereon with a casing. The conical-shape portion of the actuator ring and the conical-shape slip structures facilitate and support the radially outwardly expansion of each slip structure.

The frac plug disclosed herein thus provides a smaller outer diameter (OD) and thus smaller cross-section compared to conventional frac plugs with the same slip expansion range, and, stated alternatively, provides a larger slip expansion range compared to conventional frac plugs with the same OD.

In some embodiments, the frac plug also comprises an expandable seal element sandwiched between the actuator ring and a second end ring. The second end ring is movable towards the actuator ring to compress and expand the seal element to engage the inner diameter of a tubing string or casing. The solid engagement of the slips and the casing provides distributed support to the expansion of the seal element and prevents the seal element from being extruded from the metal interface of the frac plug and the casing wall under high pressure loading and In some embodiments, the frac plug further comprises expansion rings on the frusto-conical shaped portion of the actuator ring against the slip structure neighboring thereto, for facilitating and supporting the expansion of the slip structures under high pressure loading (which is the where most frac plugs fail).

Figure 1A:
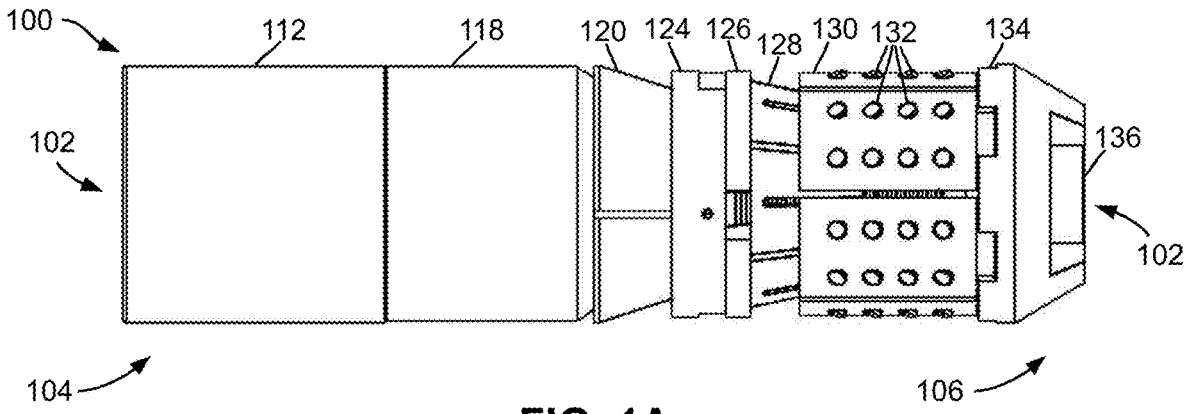
FIG. 1A is a side view of a downhole tool in the form of a frac plug, according to some embodiments of this disclosure.
Figure 1B:
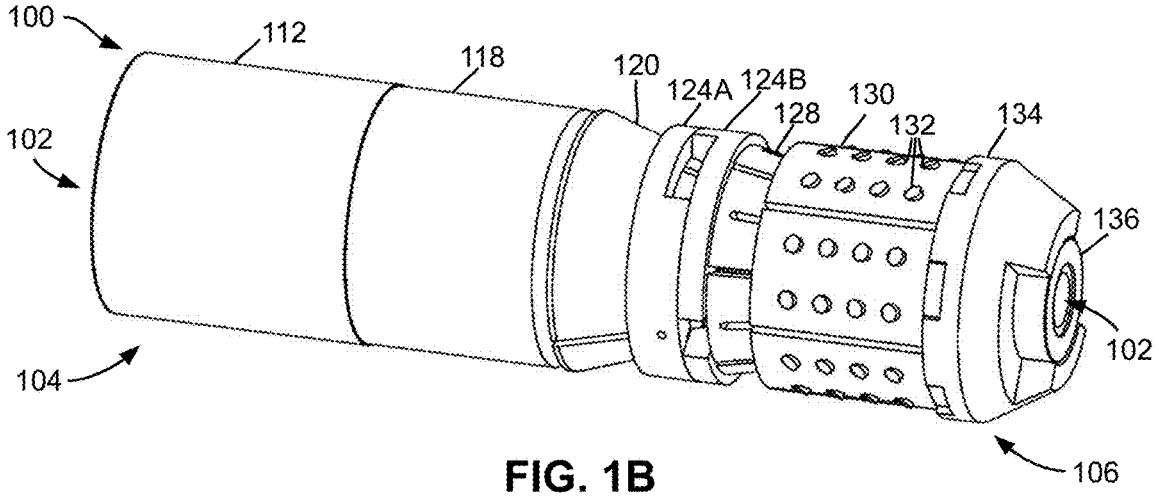
FIG. 1B is a perspective view of the frac plug shown in FIG. 1A.
Figure 1C:
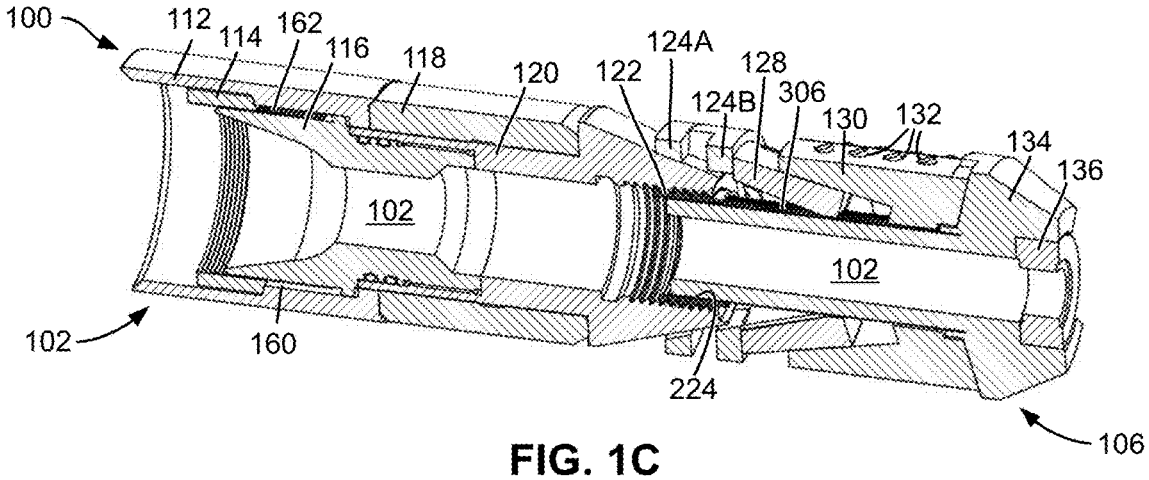
FIG. 1C is a perspective cross-sectional view of the frac plug shown in FIG. 1A.

Turning now to FIGS. 1A to 1C, a downhole tool in the form of a frac plug is shown and is generally identified using reference numeral 100. The frac plug 100 is used for isolating a zone of a wellbore uphole thereto from another zone downhole thereto for preparation of, for example, fracturing or stimulation.

In these non-limiting embodiments, the frac plug 100 has a castellation structure on at least one end thereof for allowing flow of fluid around the components of the frac plug 100 for dissolving after downhole operation (described in more detail later). The frac plug 100 has a longitudinal bore 102 extending therethrough and comprises, from the uphole side 104 to downhole side 106, a keep ring 112, a latch ring 114, an inner sleeve 116, a seal element 118, a top sub 120 having a frusto-conical portion, a body lock ring 122, a pair of expansion rings 124A and 124B, at least one inner slip structure 128, an outer slip structure 130 having a plurality of buttons 132 for engaging and gripping an interior diameter of a casing or tubing string, a bottom sub 134, and a shear ring 136. The components 112 to 136 may typically be of suitable materials as the applications may need. For example, in these embodiments, the keep ring 112, latch ring 114, inner sleeve 116, top sub 120, body lock ring 122, expansion rings 124A and 124B, inner slip structure 128, outer slip structure 130, bottom sub 134, and shear ring 136 are made of a magnesium alloy which may be dissolvable in acid environments or any other suitable degrading fluid, which advantageously allows for disintegration of the frac plug, once set in a sealing position and after completion of a fracking operation, to thereafter allow produced hydrocarbon to flow through the tubing string or casing. For example, the seal element 118 will typically be comprised of a dissolvable rubber, and the small gripping buttons 132 typically are made of steel and/or other suitable material with sufficient hardness equivalent to or greater than ALLOY 55 HRC or higher, and may comprise hardened materials such as boron-impregnated elements to better grip interior diameters of casing or tubing.

Figure 2:
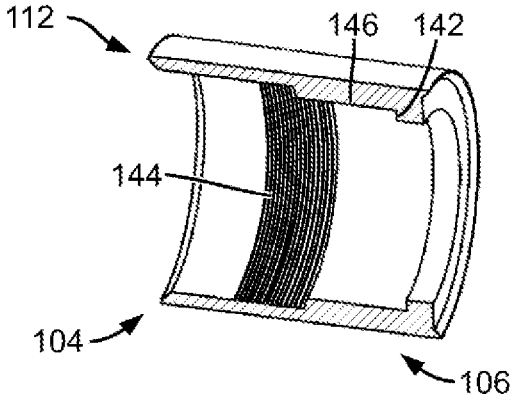
FIG. 2 is a perspective cross-sectional view of a keep ring or compression ring of the frac plug shown in FIG. 1A.

As shown in FIG. 2, the keep ring 112 comprises a uphole-facing, circumferential seat 142 on the inner surface of a downhole portion of the keep ring 112 (for example, about the downhole end 106 thereof) for receiving and engaging the inner sleeve 116, and threads 144 on the inner surface thereof uphole and at a distance to the circumferential seat 142 for coupling the latch ring 114.

Figure 3A:
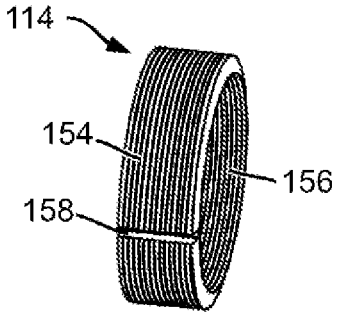
FIG. 3A is a perspective view of a latch ring of the frac plug shown in FIG. 1A.
Figure 3B:
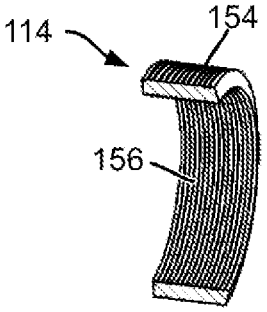
FIG. 3B is a perspective cross-sectional view of the latch ring shown in FIG. 3A.
Figure 3C:
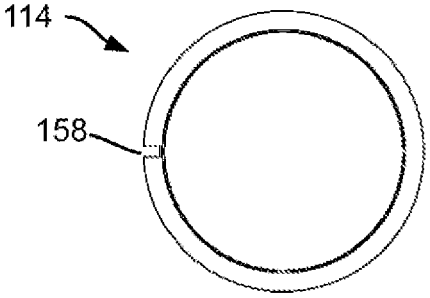
FIG. 3C is a front view of the latch ring shown in FIG. 3A.

As shown in FIGS. 3A to 3C, on the outer surface thereof, the latch ring 114 comprises threads 154 for mating the threads 144 of the keep ring 112, and a longitudinal bleeding recess 158. The latch ring 114 also comprises ratchets 156 on the inner surface thereof, as may also be clearly seen in FIG. 15A-15C. The latch ring 114 has an inner diameter (ID) smaller than or equal to that of the portion 146 of the keep ring 112 between the circumferential seat 142 and the threads 144 thereof to allow the inner sleeve 116 to longitudinally move therebetween (described in more detail later). For example, in these embodiments, the latch ring 114 has an inner diameter (ID) smaller than that of the portion 146 of the keep ring 112 thereby forming a gap 160 as seen in FIG. 1C and FIG. 15B downhole to the latch ring 114 between the keep ring 112 and the inner sleeve 116.

Figure 4:
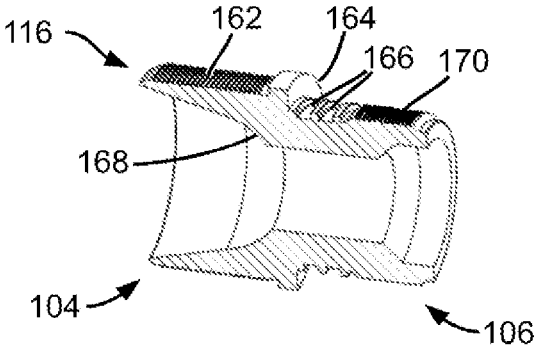
FIG. 4 is a perspective cross-sectional view of an inner sleeve of the frac plug shown in FIG. 1A.
Figure 15A:
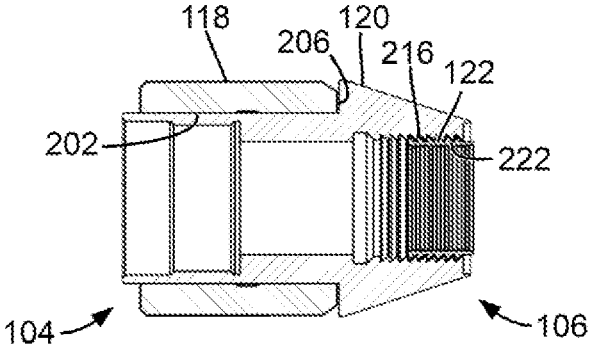
Figure 15B:
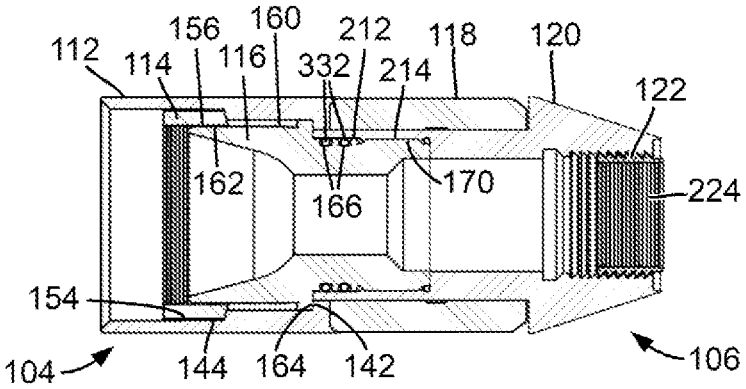

FIG. 4 (and as also shown in FIG. 15B) shows the inner sleeve 116. On the outer surface thereof, the inner sleeve 116 comprises, from the uphole side 104 to the downhole side 106 thereof, ratchets 162 for engaging the ratchets 156 of the latch ring 114, a downhole-facing, circumferential shoulder 164 for engaging the circumferential seat 142 of the keep ring 112, one or more circumferential recesses 166 for receiving one or more O-rings therein (described in more detail later), and threads 170. In these embodiments, the outer diameter (OD) of the threaded portion 170 of the inner sleeve 116 is smaller than the ID of the circumferential seat 142 of the keep ring 112. The inner sleeve 116 also comprises a seat 168 for a ball or other solid core body flowable down the casing or tubing, on the inner surface thereof about the uphole end 104.

Figure 5:
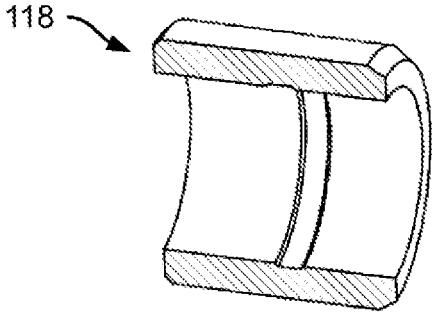
FIG. 5 is a perspective cross-sectional view of a seal element of the frac plug shown in FIG. 1A.

FIG. 5 shows the seal element 118. The seal element 118 has an ID greater than the OD of the portion 170 of the inner sleeve 116, and preferably has an OD smaller than or equal to that of the keep ring 112. The seal element is a resiliently flexible compressible material such as rubber. In a preferred embodiment the seal element may be dissolvable in a dissolving fluid, such as an acid.

Figure 6A:
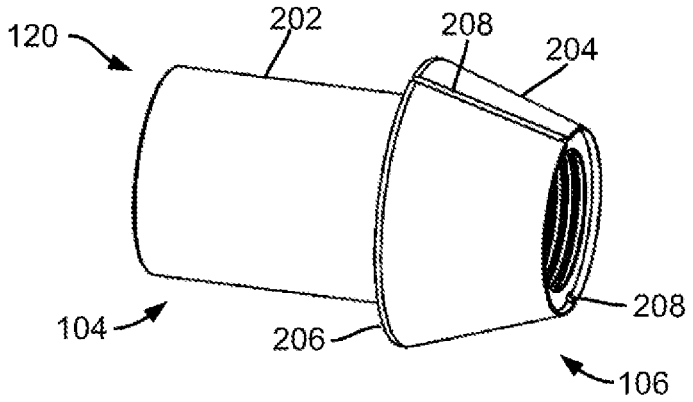
FIG. 6A is a perspective view of a top sub of the frac plug shown in FIG. 1A.
Figure 6B:
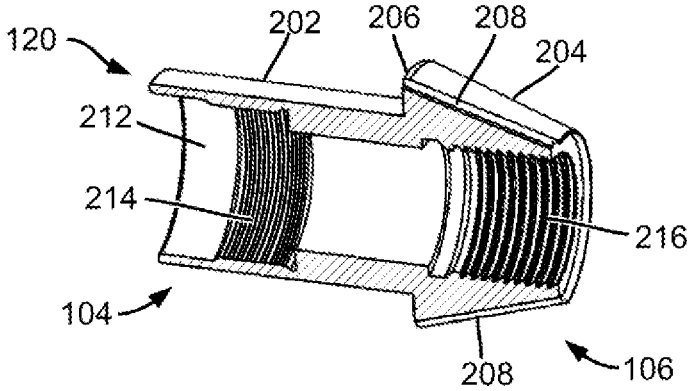
FIG. 6B is a perspective cross-sectional view of the top sub shown in FIG. 6A.

As shown in FIGS. 6A and 6B, the top sub 120 comprises a cylindrical uphole portion 202 and a conical frustum (simply denoted a "cone" for ease of description) downhole portion 204. The downhole portion 204 has a maximum OD at the uphole end thereof and tapering downhole. The maximum OD of the downhole portion 204 is greater than that of the uphole portion 202, thereby forming an uphole-facing shoulder 206 for engaging the seal element 118. The downhole portion 204 also comprises a pair of longitudinal alignment recesses 208 on the outer surface thereof for delimiting the expansion rings 124A and 124B (described in more detail later).

On the inner surface thereof, the uphole portion 202 of the top sub 120 comprises a coupling section about the uphole end 104 thereof, which comprises a smooth inner-surface subsection 212 at the position corresponding to that of the circumferential recesses 166 of the inner sleeve 116 (when they are assembled together), and a threaded subsection 214 having threads for mating the threads 170 of the inner sleeve 116.

On the inner surface thereof, the downhole portion of the top sub 120 comprises threads 216 about the downhole end thereof for receiving and mating the body lock ring 122.

Figure 7:
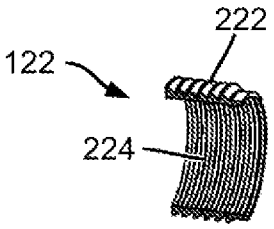
FIG. 7 is a perspective cross-sectional view of a body lock ring or retention lock ring of the frac plug shown in FIG. 1A.

As shown in FIG. 7, the body lock ring or retention ring 122 comprises threads 222 on the outer surface thereof and ratchets 224 on the inner surface thereof, and is threadably inserted in top sub 120 of FIG. 6B to thereby allow coupling of the top sub 120 to the bottom sub 134 in a ratcheting manner.

Figure 8A:
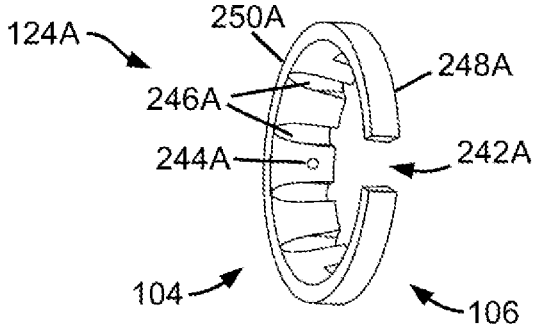
FIG. 8A is a perspective view of a first expansion ring of the frac plug shown in FIG. 1A.
Figure 8B:
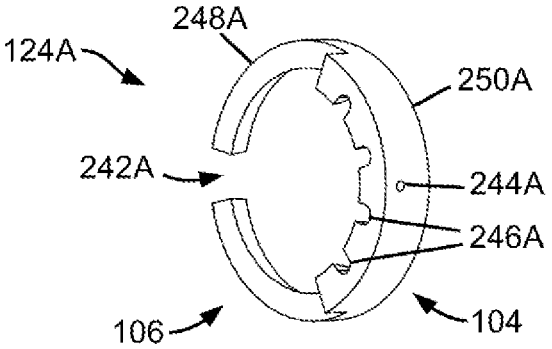
FIG. 8B is a perspective view of the first expansion ring shown in FIG. 8A, viewing from another angle.

FIGS. 8A and 8B show the uphole expansion ring 124A. As shown, the uphole expansion ring 124A is a C-shape ring having a gap 242A and a pinhole 244A on the radially opposite side thereof. On the downhole side 106 of the uphole expansion ring 124A, a portion or legs 248A thereof adjacent the gap 242A is cut off such that the thickness thereof is smaller than that of the other portion 250A adjacent the pinhole 244A. Moreover, the uphole expansion ring 124A has a conical frustum inner surface tapering from the uphole side 104 towards the downhole side 106 for mating the conical outer surface of the top sub 120, and a plurality of recesses 246A on the inner surface of the portion 250A for facilitating radially outward expansion.

Figure 9A:
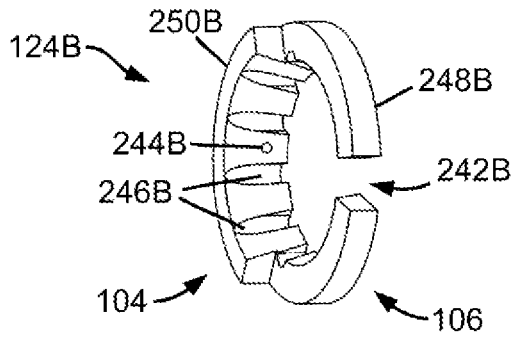
FIG. 9A is a perspective view of a second expansion ring of the frac plug shown in FIG. 1A.
Figure 9B:
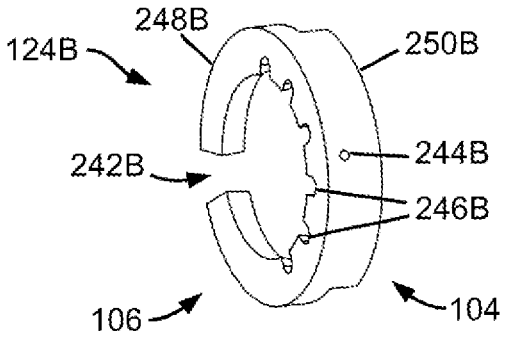
FIG. 9B is a perspective view of the second expansion ring shown in FIG. 9A, viewing from another angle.

As shown in FIGS. 9A and 9B, the downhole expansion ring 124B is complementary to the uphole expansion ring 124A. In particular, the downhole expansion ring 124B is a C-shape ring having a gap 242B and a pinhole 244B on the radially opposite side thereof. On the uphole side 104 of the downhole expansion ring 124B, a portion or legs 248B thereof adjacent the gap 242B is cut off such that the thickness thereof is smaller than that of the other portion 250B adjacent the pinhole 244B. Moreover, the downhole expansion ring 124B has a conical frustum inner surface tapering from the uphole side 104 towards the downhole side 106 for mating the conical outer surface of the top sub 120, and a plurality of recesses 246B on the inner surface of the portion 250B for facilitating uniform radially outward expansion.

Figure 10A:
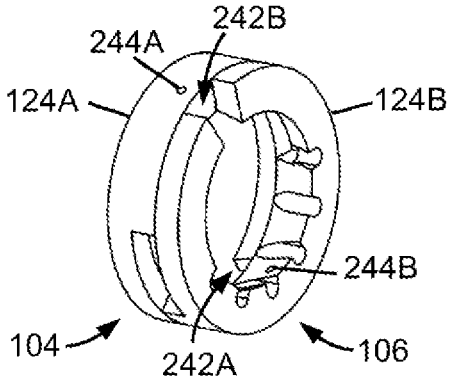
FIG. 10A is a perspective view of the coupled first and second expansion rings shown in FIGS. 8A and 9A.
Figure 10B:
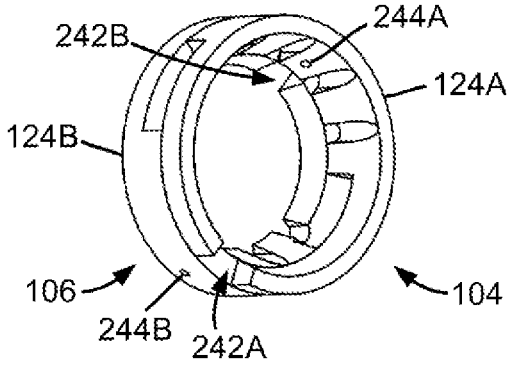
FIG. 10B is a perspective view of the coupled first and second expansion rings shown in FIGS. 8A and 9A, viewing from another angle.

FIGS. 10A and 10B show the uphole and downhole expansion rings 124A and 124B in an assembled configuration, which form a cylindrical structure with substantially uniform thickness. The legs 248A of the uphole expansion ring 124A engage the "full-thickness" portion 250B of the downhole expansion ring 124B and the legs 248B of the downhole expansion ring 124B engage the "full-thickness" portion 250A of the uphole expansion ring 124A, such that the two pinholes 244A and 244B on are radially opposite sides. Moreover, the gaps 242A and 242B seat against the "full-thickness" portion 250B and 250A, respectively, thereby allowing a uniform force transferring from the uphole side 104 to the downhole side 106. The uphole and downhole expansion rings 124A and 124B expansion rings 482 may likewise be of a material dissolvable which is dissolvable in a fluid, such as of magnesium, which dissolvable in calcium chloride or in an acid such as hydrochloric acid. Alternatively, they may be of a suitable non-dissolvable material, such as but not limited to a thermoplastic material or Teflon®.

FIGS. 11A to 11D show the inner slip structure 128. As shown, the inner slip structure 128 has a conical frustum shape with both the inner and outer surfaces thereof in conical frustum shapes. As can be seen from FIG. 11B, the thickness of the inner slip structure 128 at the uphole end 104 is smaller than that at the downhole end 106. However, those skilled in the art will appreciate that in some embodiments, the inner slip structure 128 may have a uniform thickness from the uphole end 104 to the downhole end 106.

The sidewall of the inner slip structure 128 comprises a plurality of circumferentially—juxtaposed longitudinal slots 272 alternately extending from the uphole end 104 or the downhole end 106 to positions 274 adjacent the opposite ends, thereby forming a plurality of slips 276 alternately connected to adjacent ones at the "joint" positions 274 at uphole and downhole ends.

Figure 11A:
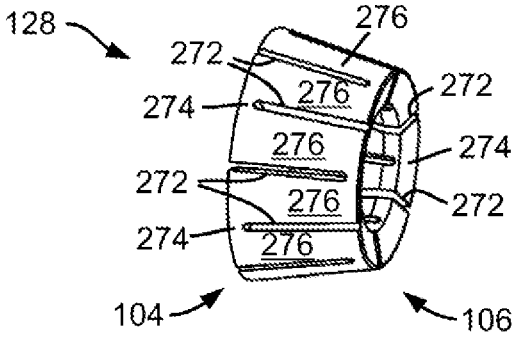
FIG. 11A is a perspective view of an inner slip structure of the frac plug shown in FIG. 1A.
Figure 11B:
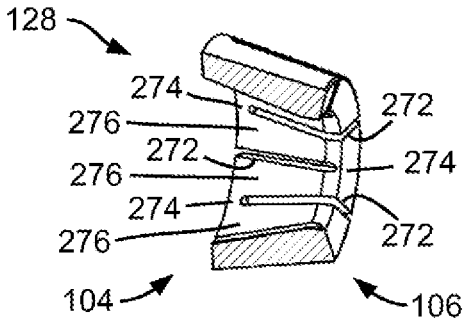
FIG. 11B is a perspective cross-sectional view of the inner slip structure shown in FIG. 11A.
Figure 11C:
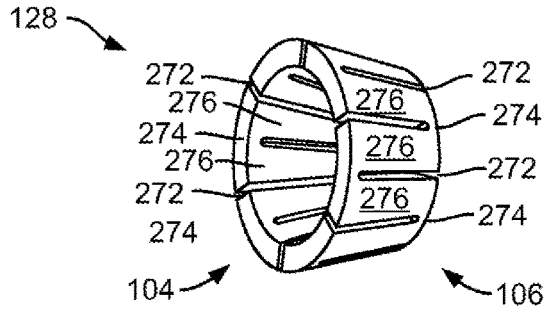
FIG. 11C is another perspective view of the inner slip structure shown in FIG. 1 and FIG. 11A, shown in a non-expanded condition.
Figure 11D:
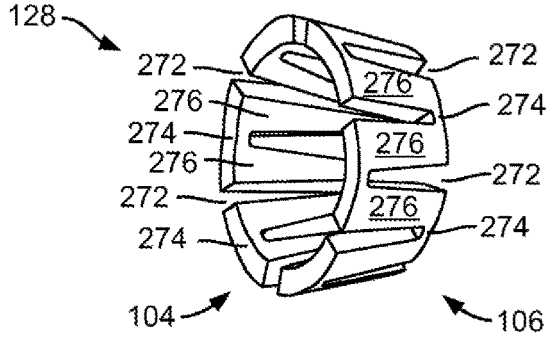
FIG. 11D is a perspective view of the inner slip structure, shown in an expanded condition.

As shown in FIG. 11D, radially outward forces applied to the inner surface of the inner slip structure 128 may cause plastic deformable expansion of the inner slip structure 128. In particular, the slips 276 may be alternately rotated about respective radial axes under the applied forces such that the width of the open end of each slot 272 increases. As a result, the inner slip structure 128 is radially outwardly expanded. While not preferred, those skilled in the art will appreciate that sufficiently large radially outward forces applied to the inner surface of the inner slip structure 128 may eventually break the connections of the slips 276, but without any loss in the functional capabilities of the inner slip structure in supporting the radially outward expansion of the outer sip structure 130 (described below).

Figure 12A:
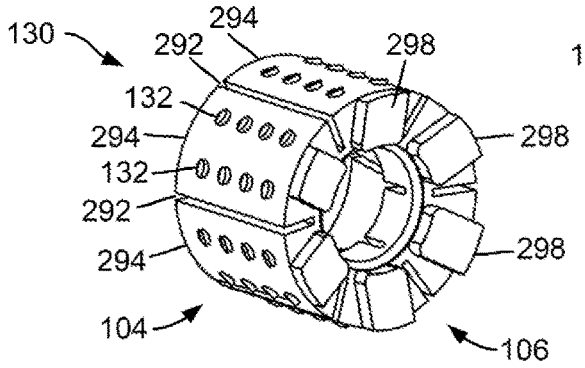
FIG. 12A is a perspective view of an outer slip structure of the frac plug shown in FIG. 1A.
Figure 12B:
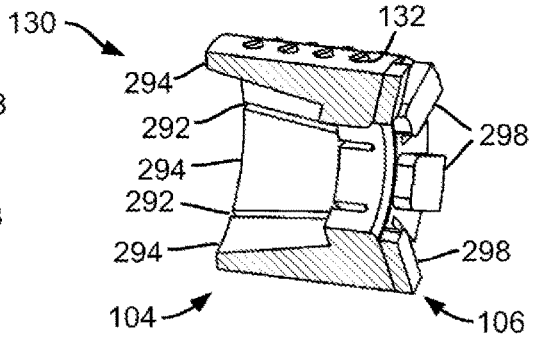
FIG. 12B is a perspective cross-sectional view of the outer slip structure shown in FIG. 12A.

FIGS. 12A and 12B show the outer slip structure 130. As shown, the outer slip structure 130 has a cylindrical shape with at least an uphole portion of its inner surface in a conical frustum shape tapering downhole from the uphole end. The outer slip structure 130 received on the outer surface thereof a plurality of slips or buttons 132. The outer slip structure 130 also comprises a plurality of slots 292 extending from the uphole end to positions adjacent the downhole end thereof, thereby forming a plurality of slips 294 connected to each other at the downhole ends thereof. The outer slip structure 130 further comprises a plurality of positioning blocks 298 distributed on the downhole end 106 thereof. Each positioning block 298 is at a position corresponding to a slip 294.

As those skilled in the art will appreciate, radially outward forces applied to the inner surface of the outer slip structure 130 may cause plastic expansion of the outer slip structure 130. In particular, the slips 294 may be radially outwardly pivoted under the applied forces. As a result, the uphole end 104 outer slip structure 130 is radially outwardly expanded. While not preferred, those skilled in the art will appreciate that sufficiently large radially outward forces applied to the inner surface of the outer slip structure 130 may eventually break the connections of the slips 294 but without any loss in the functional capabilities of the outer support structure when the frac plug is deployed so as to force the buttons 132 thereon against an inner diameter of a casing or tubing 450.

Figure 13A:
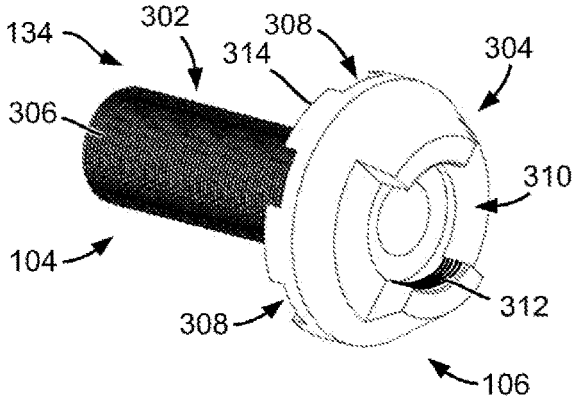
FIG. 13A is a perspective view of a bottom sub of the frac plug shown in FIG. 1A.
Figure 13B:
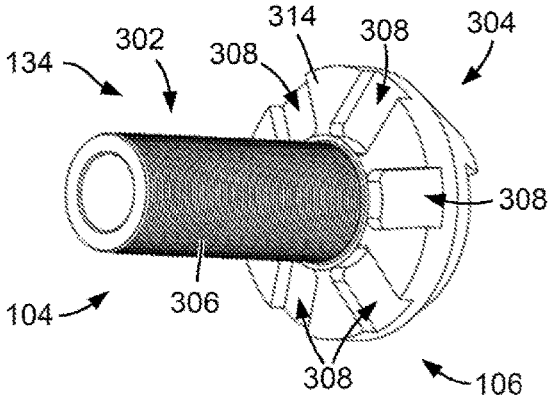
FIG. 13B is a perspective view of the bottom sub shown in FIG. 13A, viewing from another angle.
Figure 13C:
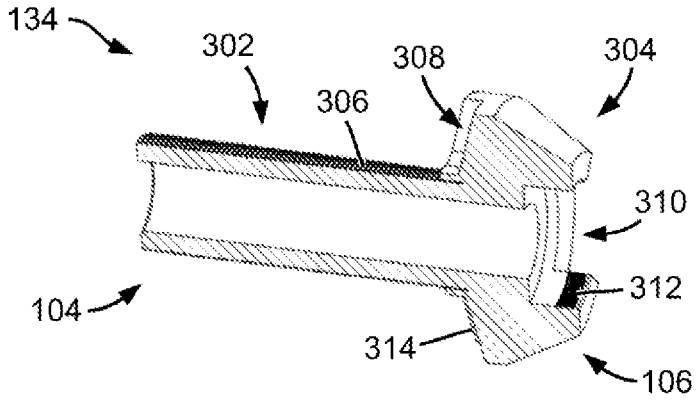
FIG. 13C is a perspective cross-sectional view of the bottom sub shown in FIG. 13A.

FIGS. 13A to 13C show the bottom sub 134. As shown, the bottom sub 134 comprises a cylindrical uphole portion 302 and a downhole portion 304. The uphole portion 302 comprises ratchets 306 on the outer surface thereof. The downhole portion has an OD greater than that of the uphole portion 302 thereby forming an uphole-facing shoulder 314, and comprises a plurality of radially extending recesses 308 on the uphole-facing shoulder 314 for receiving the positioning blocks 298 of the outer slip structure 130, and a recess 310 on the downhole end thereof with optional threads 312 on the inner surface thereof for threadably receiving the shear ring 136.

Figure 14:
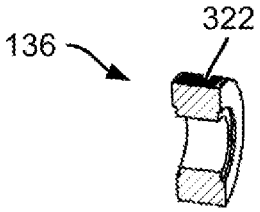
FIG. 14 is a perspective cross-sectional view of a shear ring of the frac plug shown in FIG. 1A.

FIG. 14 shows the cylindrical shear ring 136. The shear ring 136 has an ID smaller than that of the bore 102 of the rest of the frac plug 100 and is shearable under a certain force. The shear ring 136 comprises threads 322 on the outer surface thereof for mating the threads 312 of the bottom sub 134.

Figure 15C:
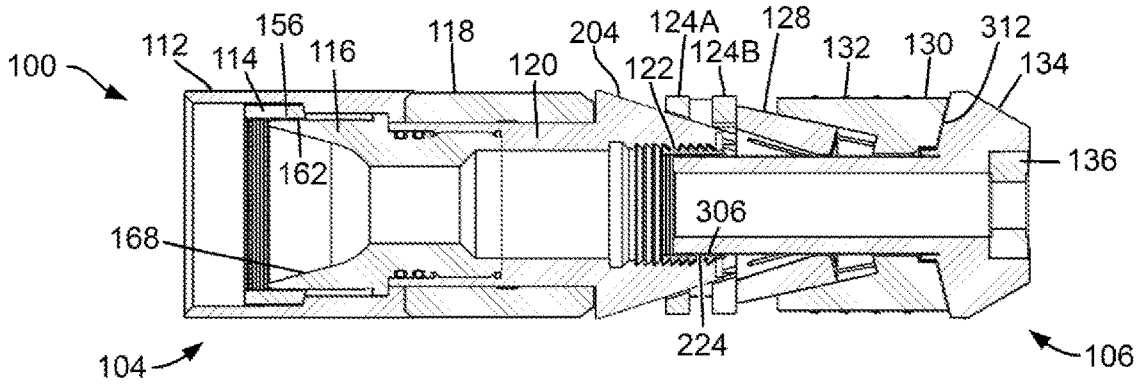

FIGS. 15A to 15C show the assembling process of the frac plug 100.

As shown in FIG. 15A, the body lock ring 122 is screwed into the downhole side 106 of the top sub 120 such that the threads 216 of the top sub 120 mate the threads 222 of the body lock ring 122 and secure the body lock ring 122 in place, and securing the top sub 120 to the bottom sub 134. The seal element 118 is coupled to the uphole portion 202 of the top sub 120 against the shoulder 206 thereof.

As shown in FIG. 15B, the keep ring 112 is coupled the uphole end 104 of the top sub 120 and engages the seal element 118. A pair of O-rings 332 are attached into the circumferential recesses 166 of the inner sleeve 116. The inner sleeve 116 is then extended into the bore of the keep ring 112 and screwed into the uphole side 104 of the top sub 120 such that circumferential shoulder 164 of the inner sleeve 116 engages the circumferential seat 142 of the keep ring 112 and the threads 214 of the top sub 120 mate the threads 170 of the inner sleeve 116 and secure the inner sleeve 116 in place. Then, the latch ring 114 is screwed into the keep ring 112 such that the ratchets 156 of the latch ring 114 engage the ratchets 162 of the inner sleeve 116 and the threads 144 of the keep ring 112 mate the threads 154 of the latch ring 114 and secure the latch ring 114 in place. As the latch ring 114 has an inner diameter (ID) smaller than that of the portion 146 of the keep ring 112, a gap 160 is formed downhole to the latch ring 114 between the keep ring 112 and the inner sleeve 116.

As shown in FIG. 15C, the shear ring 136 is attached to the downhole end 106 of the bottom sub 134 and the inner and outer slip structures 128 and 130 are coupled to the uphole portion 302 of the bottom sub 134. Each of the uphole and downhole expansion rings 124A and 124B receives an alignment pin through its pinhole 244A, 244B and the uphole and downhole expansion rings 124A and 124B are oriented to align their alignment pins with respective alignment recesses 208 of the conical-shape downhole portion 204 of the top sub 120. The expansion rings 124A and 124B are then attached to the conical-shape downhole portion 204 of the top sub 120 with their alignment pins extending into respective alignment recesses 208 for preventing rotation of the expansion rings 124A and 124B during operation.

The uphole portion 302 of the bottom sub 134 (with the inner and outer slip structures 128 and 130 thereon) is extended into the bore of the body lock ring 122 from the downhole side thereof such that the ratchets 224 of the body lock ring 122 engage the ratchets 306 of the bottom sub 134. The top sub 120 and the bottom sub 134 then sandwich the uphole and downhole expansion rings 124A and 124B and the inner and outer slip structures 128 and 130 therebetween. The slips 276 and 294 of the inner and outer slip structures 128 are in retracted positions.

Some components of the frac plug 100 may be conceptually combined.

Figure 16:
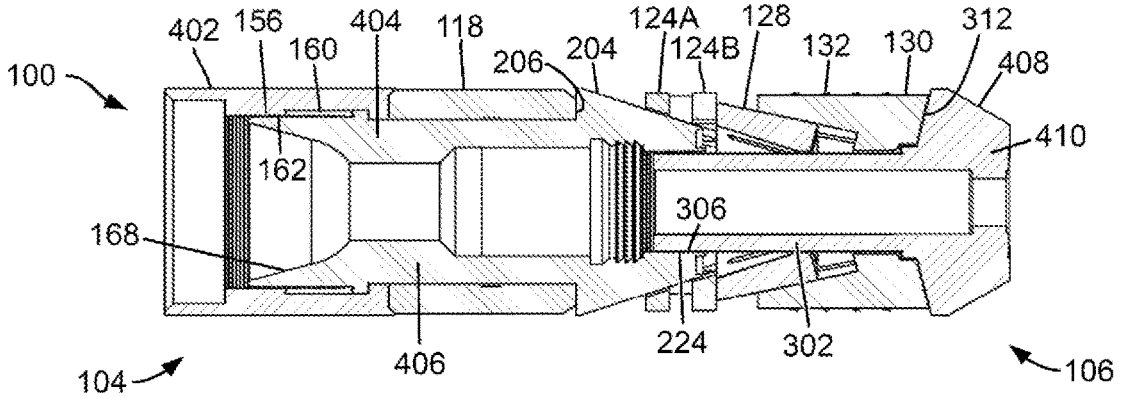
FIG. 16 is a cross-sectional view of a conceptually equivalent structure of the frac plug shown in FIG. 1A.

For example, referring to FIGS. 15C and 16, the keep ring 112 and latch ring 114 may be integrally formed, so as to provide a first ring 402 with ratchets 156 on the inner surface thereof.

Likewise, again comparing FIG. 15C with FIG. 16, the inner sleeve 116, top sub 120, and body lock ring 122 may be integrally formed together so as to form a sleeve 404 having a substantially cylindrical first portion 406 on the first side thereof (for example, the uphole side 104) and a second portion 204 on the second side thereof (for example, the downhole side 106). The first portion 406 comprises a ball seat 168 about the first end thereof and ratchets 162 on the outer surface thereof. The second portion 204 has a conical frustum shape tapering inwardly from the first side 104 thereof towards the second side 106 and comprises ratchets 224 on the inner surface thereof. The OD of the first portion 406 is smaller than the maximum OD of the second portion 204, thereby forming the circumferential shoulder 206 facing the first side 104.

The first portion 406 of the sleeve 404 extends through the bore of the seal element 118 and into the second ring 402 such that the ratchets 162 of the sleeve 404 engage the ratchets 156 of the second ring 402 and the seal element 118 is sandwiched between the second ring 402 and the shoulder 206 of the sleeve 404.

Likewise, again comparing FIG. 15C with FIG. 16, the bottom sub 134 and shear ring 136 may likewise be coupled together so as to form a first ring 408 which comprises a substantially cylindrical first portion 302 on the first side 104 and a second portion 410 on the second side 106. The first portion 302 comprises ratchets 306 on the outer surface thereof. The second portion 410 has an OD greater than that of the first portion 302 thereby forming the uphole-facing shoulder 312, and comprises a plurality of radially extending recesses 308 (not shown) on the uphole-facing shoulder 312 for receiving the positioning blocks 298 of the outer slip structure 130.

The first portion 302 of the first ring 408 extends through the outer slip structure 130, inner slip structure 128, and the expansion rings 124B and 124A into the sleeve 404 such that the ratchets 306 of the first ring 408 engage the ratchets 224 of the sleeve 404 and the outer slip structure 130, inner slip structure 128, and the expansion rings 124B and 124A are sandwiched between the second portion 204 of the sleeve 404 and the uphole-facing shoulder 314 of the first ring 408.

A variety of setting tools may be used to position and set the frac plug 100 downhole. The setting tools may be hydraulic-actuated setting tools or ballistic-actuated setting tools (when electric wireline is used) which provide linear movement actuated by hydraulic pressure or ballistic gas expansion with a sufficient stroke length such as 4 inches to 8 inches. Examples of suitable setting tools include: Fortress setting tool offered by Fortress Downhole Tools of Broussard, LA, USA, Baker 10 setting tool offered by Baker Hughes of Houston, Tex., USA, Owen T-Set or Shorty setting tools offered by Owen Oil Tools of Core Laboratories of Amsterdam, Netherlands, and other standard or non-standard hydraulic or ballistic setting tools. Such setting tools may provide a maximum output force of +/−35,000 pounds (lbs) to 50,000 lbs, depending on ID of the wellbore casing.

FIGS. 17A to 17D show the deployment of the frac plug 100.

Figure 17A:
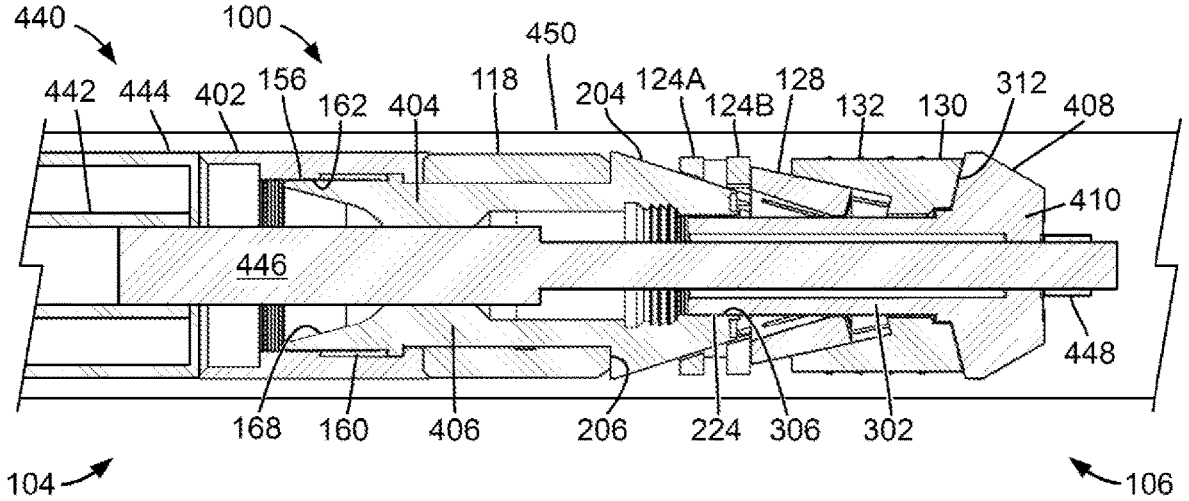

As shown in FIG. 17A the frac plug 100 is first installed to a setting tool 440. The setting tool 400 comprises a body 442 received in a sliding sleeve 444 movable towards downhole under a certain force. A mandrel 446 is coupled to the body 442 and extends downhole 106 out of the sliding sleeve 444 and through the bore of the frac plug 100. A shear nut 448, which has an OD greater than the ID of the bore of the shear pin 136 and smaller than the ID of the bore of the rest of the frac plug 100, is then coupled to the mandrel 446 against the downhole end 106 of the frac plug 100 to fasten the frac plug 100 between the sliding sleeve 444 and the shear nut 448. The assembled setting tool 440 and frac plug 100 are then run downhole in a wellbore casing 450 to the desired location, and the setting tool actuated so as to drive the outslips into the casing to secure the frac plug 100 in the bore of a casing or tubing string, and the seal element 118 thereon simultaneously compressed to seal the tubing during fracking operations, where a ball may be flowed downhole to sit in ball seat of frac plug 100, so as to along with seal element 118 effectively temporarily seal the tubing or casing, to allow fracking fluid flowed downhole to flow into apertures in the casing or tubing string immediately uphole of the frac plug. Exposure to the fracking fluid, or a subsequently-injected dissolving fluid, after a period of hours or days, thereafter dissolves the frac plug 100, thereby allowing produced hydrocarbon fluids flowing into the casing 450 to flow uphole in the tubing or casing 450.

Figure 17B:
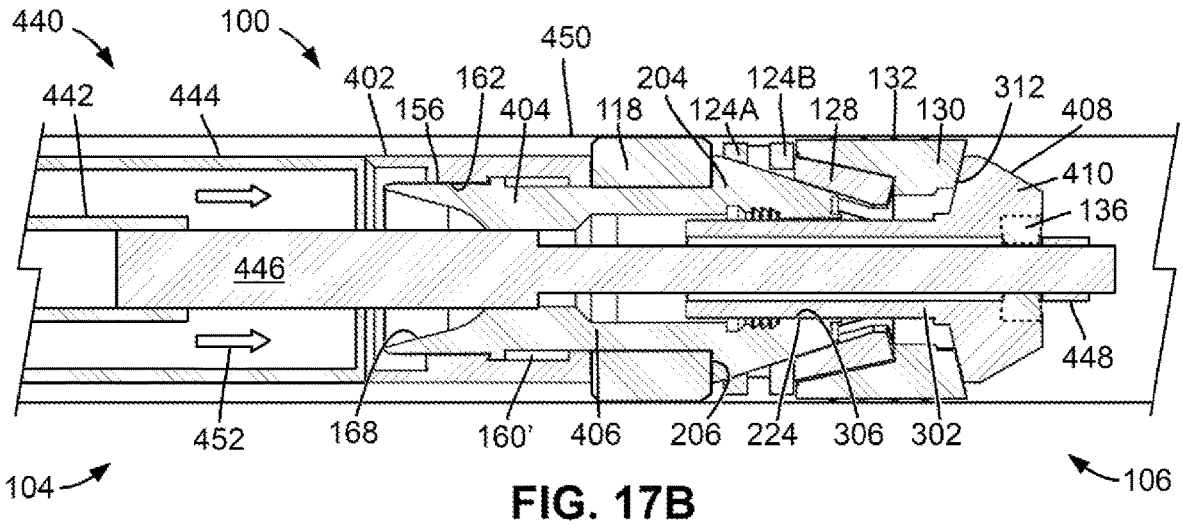

As shown in FIG. 17B, the setting tool 440 applies a setting stroke 452 (for example a hydraulic pressure) via the sliding sleeve 444 to set the frac plug 100 within a casing or tubing string. The force of the setting stroke 452 (for example, about 30,000 lbs) is greater than or equal to the force required to shear the shear ring 136 (for example, about 29,000 lbs to 30,000 lbs) and is sufficient to overcome the resistances between the ratchets 156 of the second ring 402 and the ratchets 162 of the sleeve 404 and between the ratchets 224 of the sleeve 404 and the ratchets 306 of the first ring 408. Consequently, the second ring 402 and the sleeve 404 are actuated to move together compressing seal element 118, while simultaneously as more fully explained below bottom sub 410 and sleeve 404 move together thereby causing radially outward movement of outer slip rings 132 and causing them to engage the ID of the tubing string or casing 450.

During the aforesaid movement of the first ring 402 with respect to the sleeve 404, the air or other fluid in the gap 160 bleeds out via the bleeding recess 158 and a gap 160' is formed downhole to the ratchets 162 of the sleeve 404. The seal element 118 is thus longitudinally compressed and radially outwardly expanded to engage the casing 450.

Simultaneously, the relative movement of the sleeve 404 with respect to the first ring 408 causes the conical-shaped second portion 204 of the sleeve 404 to extend through the expansion rings 124A and 124B and into the bore of the inner slip structure 128, thereby applying a radially outward force to radially outwardly expand the expansion rings 124A and 124B and the inner slip structure 128. The expansion of the inner slip structure 128 in turn applies a radially outward force to radially outwardly expand the outer slip structure 130 and force the slips 132 to engage the casing 450. The frac plug 100 is the set. The engaged ratchets 156/162 and 224/306 maintains the structure of the frac plug 100.

Figure 17C:
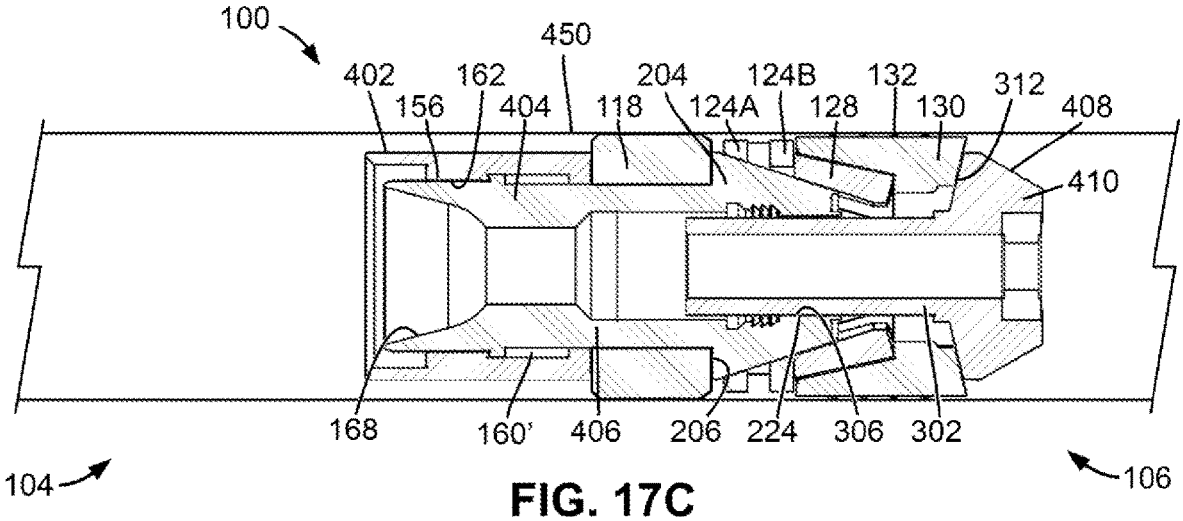

Once the slips 132 engage the casing 450, the setting force 452 anchors or stores energy in the engagement with the wellbore casing. When the outer slips 132 stops travelling further, the setting force 452 shears the shear ring 136. The setting tool 442 is then able to be retrieved to surface (FIG. 17C).

Figure 17D:
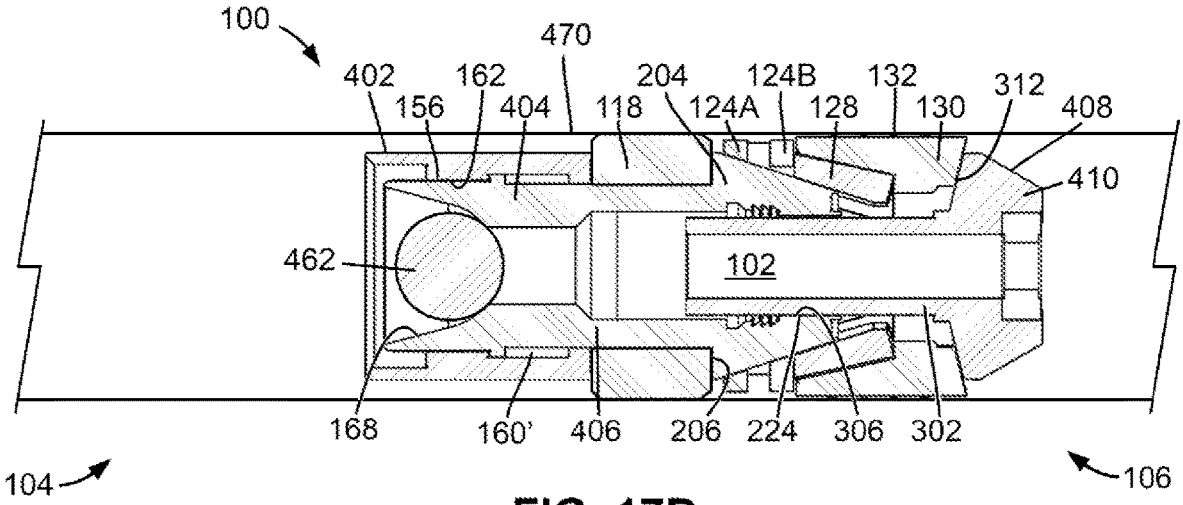

As shown in FIG. 17D, a ball 462 may thereafter be dropped from surface to the ball seat 168 of the second ring 402 to close the bore 102 of the frac plug 100. The wellbore portion uphole to the frac plug 100 is then isolated from the wellbore portion downhole thereto. Other uphole operations, for example, fracturing or stimulation, may then be conducted.

As described above, the components of the frac plug 100 (except the seal element 118 and the slips 132) are made of dissolvable magnesium alloy. Thus the frac plug may be completely dissolved when in contact with injection fluid (dissolved in, for example, about 18 days), calcium chloride mix (dissolved in, for example, in about 3 days), or an acid (dissolved within, for example, several hours).

As those skilled in the art will appreciate, by using the one or more inner slip structure 128 between the top sub 120 (which acts as an actuator) and the outer slip structure 130 (which comprises slips 132 thereon and is actuated to expand and engage the casing), the outer slip structure 130 may be radially outwardly actuated further than conventional slip structures. Therefore, the frac plug 100 disclosed herein with the same maximum OD of a conventional frac plug may be used for setting the frac plug 100 in a larger wellbore casing.

Alternatively, compared to the conventional frac plugs, the one or more inner slip structure 128 and the outer slip structure 130 of the frac plug 100 disclosed herein may be made with smaller maximum ODs and smaller lengths in order to set in the casing with the same ID. For example, compared to the conventional frac plugs that have a maximum OD of about 88% to 92% of the typical casing ID, the frac plug 100 disclosed herein has a maximum OD of about 75% to 78% of the typical casing ID.

Thus, with the reduced maximum OD, the frac plug 100 disclosed herein may be easier to run through curved or bent tubings with less tendency to be stuck or lodged therein, compared to the conventional frac plugs. Moreover, the frac plug 100 disclosed herein may run through many wellbore restrictions and/or damaged casing sections that conventional frac plugs cannot run through.

Moreover, during the relative movement of the sleeve 404 with respect to the first ring 408 (or in particular the top sub 120), the expansion rings 124A and 124B are pushed by the inner slip structure 128 and travel up the conical-shape portion 204 of the top sub 120. The expansion rings 124A and 124B thus provide retention of and control of the expansion of the inner and outer slip structures 128 and 130. The expansion rings 124A and 124B also may provide retention on one side of the seal element 118, assisting in retaining seal element being forced against casing 450.

Figure 18:
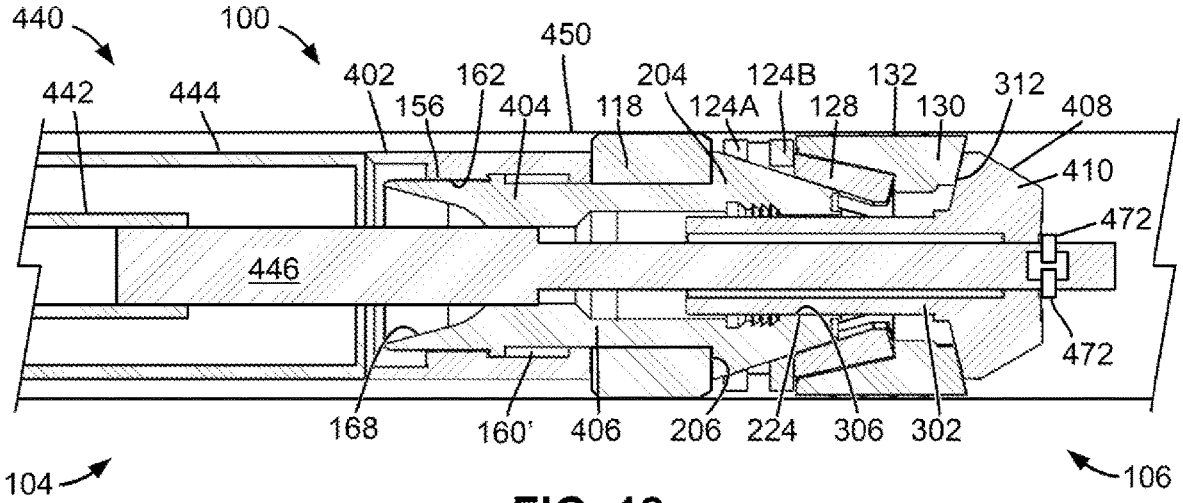
FIG. 18 is a cross-sectional view of a setting tool setting the frac plug shown in FIG. 1A downhole in a wellbore casing, according to some embodiments of this disclosure.

In some embodiments, the frac plug 100 may not comprise a shear ring 136. Accordingly, the setting tool 442 does not comprise the shear nut 448. As shown in FIG. 18, the setting tool 442 in these embodiments comprises a set of retractable pins 472 about the downhole end of the mandrel 446 against the downhole end of the frac plug 100. After setting the frac plug 100, the retractable pins 472 are retracted (for example, via a motor (not shown) under the control from surface, or via a hydraulic actuation structure (not shown) to retract, thereby allowing the setting tool 442 to retrieve to the surface.

Figure 19:
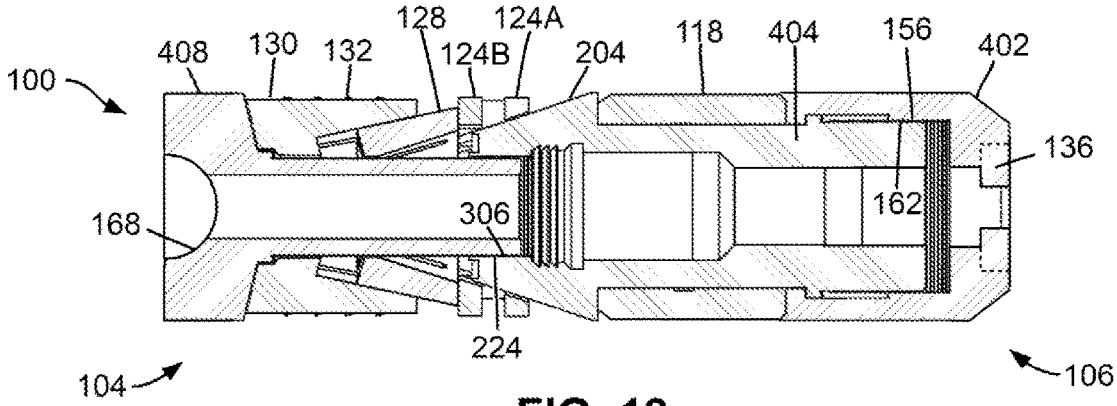
FIG. 19 is a cross-sectional view of a downhole tool in the form of a frac plug, according to some embodiments of this disclosure.

FIG. 19 shows the frac plug 100 in some alternative embodiments. As shown, the frac plug 100 in these embodiments is substantially mirrored from that shown in FIGS. 1A to 1C (also see FIG. 15C) except that the first ring 402 (which is now on the downhole side) comprises the shear ring 136 and the second ring 408 (now on the uphole side) comprises the ball seat 168.

Figure 20A:
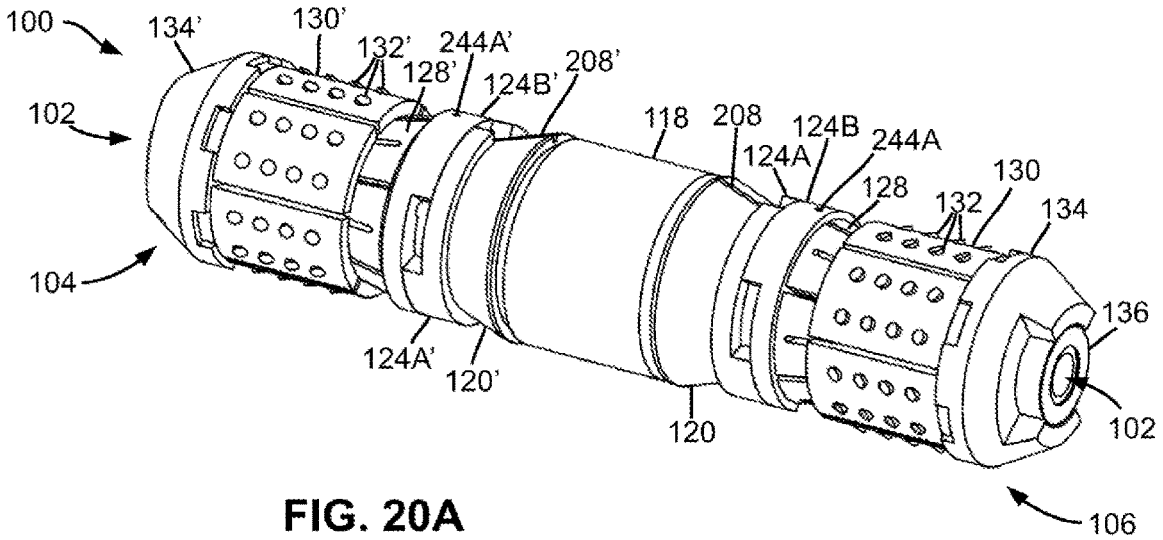
FIG. 20A is a perspective view of a downhole tool in the form of a frac plug, according to yet some embodiments of this disclosure.
Figure 20B:
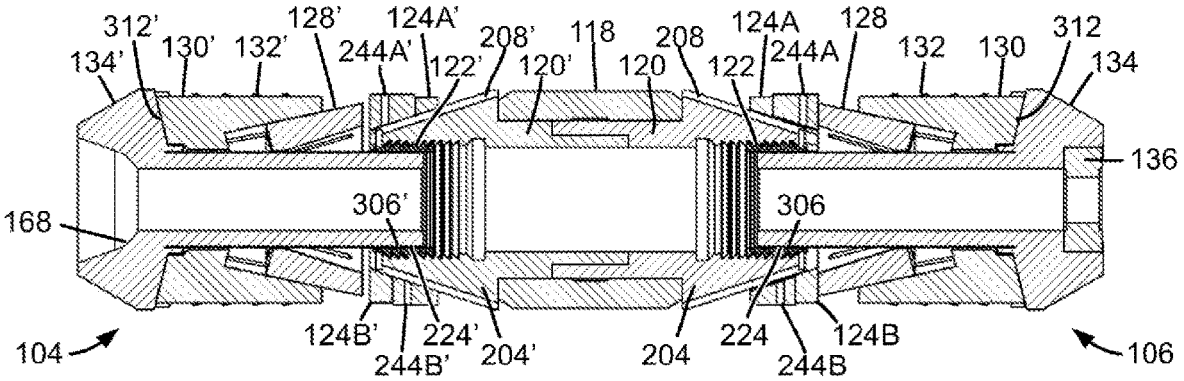
FIG. 20B is a cross-sectional view of the frac plug shown in FIG. 20A.

FIGS. 20A and 20B show the frac plug 100 in still some alternative embodiments. The frac plug 100 in these embodiments comprises a single seal element 118 at the center therefrom and comprises two sets of the top sub 120, the body lock ring 122, the expansion rings 124A and 124B, at least one inner slip structure 128, and the outer slip structure 130 on the uphole and downhole sides of the seal element 118 (the set of components uphole to the seal element 118 are marked in FIGS. 20A and 20B with the symbol "'" affixed to respective reference numerals). The two sets of are in a mirrored configuration with respect to the seal element 118.

The frac plug 100 also comprises a bottom sub 134 downhole to the outer slip structure 130 (similar to the frac plug described above) and a shear ring 136 coupled to the downhole end of the bottom sub 134. The frac plug 100 further comprises a top sub 134' uphole to the uphole outer slip structure 130'. The top sub 134' is similar to the bottom sub 134 except that the top sub 134' comprises a ball seat 168 (and does not receive any shear ring 136).

Figure 21:
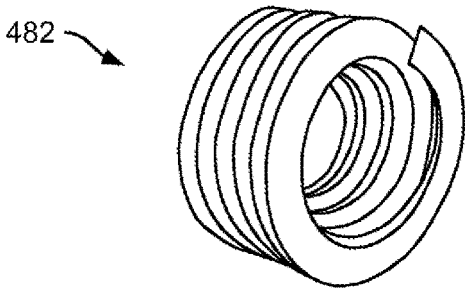
FIG. 21 is a perspective view of a spiral expansion ring of the frac plug shown in FIGS. 1A, 19, and 20A.

In some alternative embodiments, the expansion rings 124A and 124B may be substituted with other suitable expansion rings such as the spiral expansion ring 482 as shown in FIG. 21. The spiral expansion ring 482 may have a cylindrical shape, a conical frustum shape, or the like, and may be made of a suitable material such as a thermoplastic material or Teflon, or alternatively likewise of a material dissolvable which is dissolvable in a fluid, such as of magnesium, dissolvable in calcium chloride or in an acid such as hydrochloric acid.

In some alternative embodiments, the frac plug 100 may not comprise any expansion rings.

In some alternative embodiments, the frac plug 100 may not comprise the seal element and therefore, the frac plug 100 may not comprise the keep ring and the latch ring.

In above embodiments, the shear ring 136 is coupled to the bottom sub 134 via threads. In some alternative embodiments, the shear ring 136 may be coupled to the bottom sub 134 using a plurality of equally rated screw pins or screws. In some embodiments, the shear ring 136 may not be coupled to the bottom sub 134, but merely nest in a mating aperture in bottom sub 134.

In some alternative embodiments, the downhole tool 100 having a similar structure as described above (for example, having similar components for actuating the slips 132 and/or the seal elements 118) may be any downhole tools that require actuation of the slips and/or the seal elements. Those skilled in the art will appreciate that the frac plug 100 described is an example only and many features thereof may be used in other downhole tools individually or in combination.

Although embodiments have been described above with reference to the accompanying drawings, those of skill in the art will appreciate that variations and modifications may be made without departing from the scope thereof as defined by the appended claims.

What is claimed is:

1. A generally cylindrical downhole apparatus having a first side and a second side and a longitudinal axis, the apparatus comprising:

an actuator ring having a conical frustum portion tapering radially inwardly towards the first side of the apparatus and having a longitudinal bore co-axially aligned on said longitudinal axis of the apparatus;

first and second slips each frusto-conical in shape and tapering towards the first side of said apparatus and each being substantially hollow and having a conical bore, each slip co-axially positioned in juxtaposed relation to the other on the longitudinal axis of the apparatus, with the first slip relative to said second slip situated on said apparatus closest said first side of the apparatus, the first slip overlying a portion of said second slip such that a tapered portion of the second slip is within the conical bore of the first slip, each of the slips being radially segmented along a respective length thereof and about a circumference thereof and each being radially outwardly expandable;

at least one expansion ring longitudinally movably situated along the conical frustum portion of the actuator ring, the at least one expansion ring also radially outwardly expandable when longitudinally moving along said conical frustum portion of the actuator ring towards the second side of the appartus, for facilitating and supporting the radially outward expansion of the second slip;

a first end ring having a first portion engaging the first slip at a longitudinal end of said first slip closest the first side of the apparatus, and having a second portion extending longitudinally in a direction from the first portion into the longitudinal bore of the actuator ring and engaging therewith for sandwiching the first and second slips between the actuator ring and the first end ring;

wherein the actuator ring is longitudinally movable with respect to the first end ring such that when one is moved longitudinally towards the other the conical frustum portion of the actuator ring extends into the conical bore of the second slip and causes the second slip to radially outwardly expand and to move longitudinally further into the conical bore of the first slip and simultaneously cause that portion of the first slip overlying the second slip to also radially outwardly expand; and wherein the at least ne expansion ring comprises;

a pair of C-shaped expansion rings each having a gap, and wherein the pair of C-shaped expansion rings are oriented such that the respective gaps of each of the C-shaped expansion rings are unaligned; or a spiral ring.

2. The downhole apparatus of claim 1 further comprising:

a seal element, having a first side abutting the conical frustum portion of the actuator ring and having a second side, the second side of the seal element longitudinally opposite to the first side of the seal element and closer to the second side of the apparatus, the seal element having a longitudinal bore co-axial with said longitudinal axis; and a second end ring abutting the second side of the seal element;

wherein the actuator ring comprises a second portion extending towards the second side through the bore of the seal element and engaging the second end ring; and wherein the second end ring is movable towards the actuator ring for compressing and radially outwardly expanding the seal element.

3. The downhole apparatus of claim 1, wherein said actuator ring has a ball seat on a side thereof corresponding to said second side of said downhole apparatus.

4. A generally cylindrical downhole apparatus having a first downhole side and a second uphole side and a longitudinal axis, the apparatus comprising:

an actuator ring having a conical frustum portion tapering radially inwardly towards said first downhole side of the apparatus and having a longitudinal bore co-axially aligned on said longitudinal axis of the apparatus;

first and second slips, each frusto-conical in shape and tapering towards the first downhole side of said apparatus and each being substantially hollow and having a conical bore, each slip co-axially positioned in juxtaposed relation to the other on the longitudinal axis of the apparatus, with said first slip relative to said second slip situated on said apparatus closest said first downhole side of the apparatus, the first slip overlying a portion of said second slip such that a tapered portion of the second slip is within the conical bore of the first slip, each of the slips being radially segmented along a respective length thereof and about a circumference thereof and each being radially outwardly expandable;

at least one expansion ring longitudinally movably situated along the conical frustum portion of the actuator ring, the at least one expansion ring also radially outwardly expandable when longitudinally moving along said conical frustum portion of the actuator ring towards the second side of the appartus, for facilitating and supporting the radially outward expansion of the second slip;

a first end ring having a first portion engaging the first slip at a longitudinal end of said first slip closest the first downhole side of the apparatus and having a second portion extending longitudinally in a direction towards the second uphole side into the longitudinal bore of the actuator ring and engaging therewith for sandwiching the first and second slips between the actuator ring and the first end ring;

wherein the actuator ring is longitudinally movable with respect to the first end ring such that when one is moved longitudinally towards the other the conical frustum portion of the actuator ring extends into the conical bore of the second slip and causes the second slip to radially outwardly expand and to move longitudinally further into the conical bore of the first slip and simultaneously cause that portion of the first slip overlying the second slip to also radially outwardly expand; and wherein the at least one expansion ring comprises;

a pair of C-shaped expansion rings each having a gap, and wherein the pair of C-shaped expansion rings are oriented such that the respective gaps of each of the C-shaped expansion rings are unaligned; or a spiral ring.

5. The downhole apparatus of claim 4 further comprising:

a seal element having a first side abutting the conical frustum portion of the actuator ring and having a second side, the second side of the seal element longitudinally opposite to the first side of the seal element and closer to the second uphole side of the apparatus, the seal element having a longitudinal bore co-axial with said longitudinal axis; and a second end ring abutting the second side of the seal element;

wherein the actuator ring comprises a second portion extending towards the second uphole side of the apparatus through the bore of the seal element and engaging the second end ring; and wherein the second end ring is movable towards the actuator ring for compressing and radially outwardly expanding the seal element.

6. The downhole apparatus of claim 4, wherein said actuator ring has a ball seat on a side thereof corresponding to the second uphole side of said downhole apparatus.

7. A generally cylindrical downhole apparatus having a first downhole end and a second uphole end and a longitudinal axis, the apparatus comprising:

an actuator ring having a first conical frustum portion tapering radially inwardly towards said second uphole end of the apparatus and having a longitudinal bore co-axially aligned on said longitudinal axis of the apparatus;

first and second slips each frusto-conical in shape and tapering towards the second uphole end of said apparatus and each being substantially hollow and having a conical bore, each slip co-axially positioned in juxtaposed relation to the other on the longitudinal axis of the apparatus, with the first slip relative to said second slip situated on said apparatus closest said second uphole end of the apparatus, the first slip overlying a portion of said second slip such that a tapered portion of the second slip is within the conical bore of the first slip, each of the slips being radially segmented along a respective length thereof and about a circumference thereof and each being radially outwardly expandable;

at least one expansion ring longitudinally movably situated along the conical frustum portion of the actuator ring, the at least one expansion ring also radially outwardly expandable when longitudinally moving along said conical frustum portion of the actuator ring towards the second side of the apparatus, for faciliating and supporting the radially outward expansion of the second slip;

a cylindrical seal element having a longitudinal bore situated co-axially with said longitudinal axis and axially compressible by longitudinal movement of said actuator ring;

a first end ring on said second uphole end of said downhole apparatus having a first portion engaging the first slip at a longitudinal end of said first slip closest the second uphole end of the apparatus and having a second portion extending longitudinally in a direction towards the first downhole end of the apparatus into the longitudinal bore of the actuator ring for sandwiching the first and second slips between the actuator ring and the first end ring;

wherein the actuator ring is longitudinally movable with respect to the first end ring such that when one is moved longitudinally towards the other:

(i) the conical frustum portion of the actuator ring extends into the conical bore of the second slip and causes the second slip to radially outwardly expand and to move longitudinally further into the conical bore of the first slip and simultaneously cause that portion of the first slip overlying the second slip to also radially outwardly expand; and (ii) cause said seal element to be axially compressed and thereby radially outwardly expand; and wherein the at least one expansion ring comprises;

a pair of C-shaped expansion rings each having a gap, and wherein the pair of C-shaped expansion rings are oriented such that the respective gaps of each of the C-shaped expansion rings are unaligned; or a spiral ring.

8. The downhole apparatus of claim 7 wherein:

said cylindrical seal element is situated at a downhole end of the conical frustum portion of the actuator ring; and further comprising a second end ring on a downhole end of the cylindrical seal element;

wherein the actuator ring comprises a second portion extending towards the downhole end of the apparatus through the longitudinal bore of the seal element and engaging the second end ring; and wherein when the second end ring and actuator ring are moved towards each other the seal element is axially compressed and thereby radially outwardly expanded.

9. The downhole apparatus of claim 7, wherein said actuator ring has a ball seat proximate the second uphole end of said downhole apparatus.

* * * * *